US005356298A

United States Patent [19]

Voss et al.

[11] Patent Number: 5,356,298

[45] Date of Patent: Oct. 18, 1994

[54] WIDEBAND SOLDERLESS RIGHT-ANGLE RF INTERCONNECT

[75] Inventors: John D. Voss, San Diego; Stephen C. Ellis, Murrieta; Robert G. Riddle, Escondido; Jeffrey A. Douglass, Poway, all of Calif.

[73] Assignee: TRW Inc., Redondo Beach, Calif.

[21] Appl. No.: 42,565

[22] Filed: Apr. 1, 1993

[51] Int. Cl.[5] ..... H01R 9/09

[52] U.S. Cl. ..... 439/63; 439/91; 439/581

[58] Field of Search ..... 333/33, 260, 261; 439/63, 578–585, 86, 91, 89, 90

[56] References Cited

U.S. PATENT DOCUMENTS

| | | | |
|---|---|---|---|
| 3,622,915 | 11/1971 | Davo | 439/581 |
| 4,534,602 | 8/1985 | Bley | 439/63 |
| 4,588,241 | 5/1986 | Ardezzone | 439/581 |
| 4,669,805 | 6/1987 | Kosugi | 439/581 |
| 4,882,657 | 11/1989 | Braun | 439/91 |
| 4,992,053 | 2/1991 | Lindemann et al. | 439/91 |
| 5,007,843 | 4/1991 | Smolley | 439/591 |
| 5,123,863 | 6/1992 | Frederick et al. . | |

*Primary Examiner*—David L. Pirlot

*Attorney, Agent, or Firm*—G. Gregory Schivley; Robert W. Keller

[57] ABSTRACT

A solderless right-angle interconnect is provided for achieving flexible, low-profile and enhanced performance high frequency signal interconnections. The interconnect includes a conductive pin which has a first end electrically coupled to a first transmission path and a second end electrically coupled to a stripline circuit trace which provides a second transmission path. A springy compressible conductive button is located in a recessed chamber at the second end of the conductive pin and partially extends from the end thereof. The second end of the conductive pin further includes at least one tapered edge. A conductive ground layer is further provided for substantially enclosing the interconnect and providing a ground reference thereabout. In a first embodiment, the conductor forming the first transmission path includes a coaxial cable coupled to the conductive pin. In a second embodiment, the first transmission path may include a second stripline circuit trace, in which the first end of said conductive pin likewise includes a recessed chamber for receiving a springy compressible conductive button and at least one tapered edge.

22 Claims, 4 Drawing Sheets

WIDEBAND SOLDERLESS RIGHT-ANGLE RF INTERCONNECT

This Invention herein described has been made in the course of or under U.S. Government Contract No. F33615-90-C-1448 or a Subcontract thereunder with the Department of Air Force.

BACKGROUND OF THE INVENTION

1. Technical Field

This invention relates generally to a connector for connecting transmissions paths and, more particularly, to a right-angle interconnect for providing signal transitions between high frequency signal transmission paths such as those provided by stripline circuit traces found on circuit boards.

2. Discussion

Transmissions paths are commonly used to carry and distribute signals such as those found in the radio and microwave frequency range. Interconnects are frequently employed to connect one transmission path to another transmission path for purposes of providing signal transitions therebetween. For instance, interconnects are often used to provide external electrical connections between, for example, coaxial cables and circuit traces located on a circuit board. In other instances, interconnects are often used to form an electrical connection between a pair of circuit traces on adjacent circuit boards.

Prior conventional coaxial cable interconnects have been used to provide signal transitions between a first transmission path in a coaxial cable and a second transmission path. These conventional interconnects have generally included a simple soldering splice formed directly between the inner conductor of the coaxial cable and the circuit traces. While such interconnects have served to a limited extent, they generally have experienced rather poor signal performance, especially at high frequencies. In addition, while solder joints have commonly been employed in the past to form an adequate connection between the two conductors, solder connections generally involve additional costs which includes costs incurred for assembly labor and materials. Furthermore, the reliance on solder joints may also lead to limited reliability and inflexibility.

More recently, in lieu of the prior conventional coaxial cable interconnects, commercially available interconnect systems have been used to electrically interface circuit traces. These commercially available coplanar interconnects are generally known throughout the field as "SMA" type connectors which may include a flange that surrounds the circuit and a cylindrical center pin that contacts the circuit. Existing "SMA" type connectors include a coplanar interface known as an end launch and a ninety degree (90°) interface known as a surface launch such as the type manufactured by Omni-Spectra. The surface launch interconnect provides a right-angle coax connector to stripline connection. However, like prior conventional systems, the commercially available right angle interconnects generally exhibit poor performance at high frequencies and do not offer the flexibility that may be desired with modern day electronic systems, especially those operating in the RF/microwave frequency range and above.

While existing right-angle interconnect systems have attempted to achieve signal transitions for modern day electronic systems, such interconnects have typically exhibited rather poor electrical performance at higher frequencies, especially those approaching 10 GHz and higher. This is generally due to the sensitive characteristics of high frequency signals which may result in poor voltage standing wave ratio (VSWR) and propagation and launching of unwanted higher-order transmission line modes within the associated circuitry. In addition, commercially available interconnect systems are considerably large in view of modern day electronic systems. Accordingly, the poor performance and large size are undesirable characteristics exhibited by existing interconnects when used with high-frequency state-of-the-art RF/microwave electrical systems which are currently available and those that will be available in the future.

It is therefore desirable to provide for a more flexible solderless interconnect for providing enhanced performance high frequency signal transitions between transmissions paths. More particularly, it is desirable to provide for an enhanced profile solderless interconnect for achieving high frequency signal transitions between a stripline circuit trace and a coaxial cable. In addition, it is further desirable to provide for such a solderless interconnect to achieve enhanced performance high frequency signal transitions between stripline circuit layers within a multiple-layer circuit board. Furthermore, it is desirable to provide for such interconnects which may achieve wide instantaneous bandwidths and lightweight, low cost, low-profile packaging for use with RF and microwave electronic systems.

SUMMARY OF THE INVENTION

In accordance with the teachings of the present invention, a right-angle interconnect is provided which includes a conductive pin coupled between a stripline circuit trace that forms a first transmission path and a conductor which forms a second transmission path. A springy compressible conductive button is substantially located in a chamber at one end of the conductive pin and partially extends from the end thereof. The one end of the pin further includes at least one tapered edge. A conductive ground layer is further provided for substantially enclosing the interconnect and providing a ground reference thereabout. In addition, the interconnect provides a controlled impedance isolation between the transmission paths and the ground reference. In a first embodiment, the conductor foraging the second transmission path includes a coaxial cable coupled to the conductive pin. In a second embodiment, the second transmission path may include a second stripline circuit trace, wherein the first and second circuit traces are located within a multiple-layer circuit board and the second end of the conductive pin has a second chamber for receiving a second springy compressible conductive button and a second tapered edge.

BRIEF DESCRIPTION OF THE DRAWINGS

Other objects and advantages of the present invention will become apparent to those skilled in the art upon reading the following detailed description and upon reference to the drawings in which.

DETAILED DESCRIPTION OF THE PREFERRED EMBODIMENTS

Figure 1:
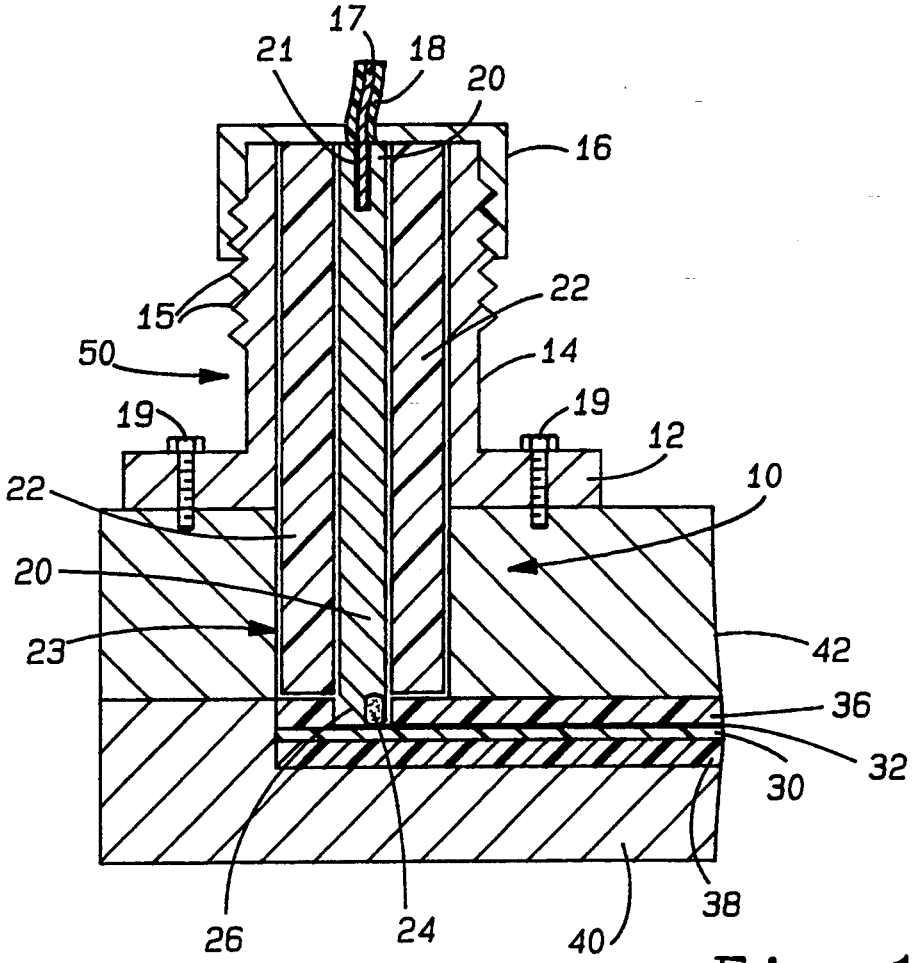
FIG. 1 is a cross-sectional view taken through a pin centerline of a right-angle signal interconnection forming an electrical connection between a coaxial cable and a stripline circuit in accordance with a first embodiment of the present invention.
Figure 2:
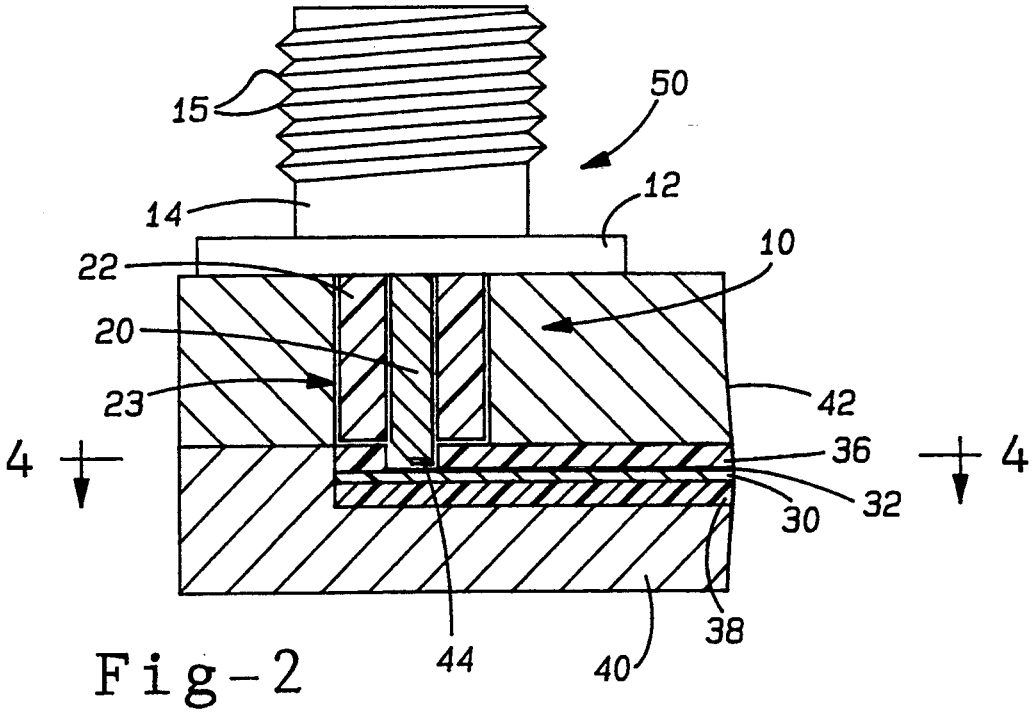
FIG. 2 is a partial cross-sectional view taken in front of the pin of the first embodiment of the signal interconnect as shown in FIG. 1.

Turning now to FIGS. 1 and 2, a solderless right-angle interconnect 10 is shown in accordance with a first embodiment of the present invention for providing high frequency right-angle signal transitions between a coaxial connector assembly 50 which is coupled to a coaxial cable 18 and a stripline circuit trace 32 that is generally found on a circuit board 30 located within a conductive housing 40 and 42. The interconnect 10 as described herein is employed to achieve enhanced performance of right-angle high frequency signal transitions between a pair of transmission paths. While the interconnect 10 is initially described in connection with a right-angle interconnection between a coaxial cable 18 and a circuit trace 32, the invention further pertains to right-angle interconnections between a pair of circuit traces. Accordingly, the present invention is also further described below in connection with a second embodiment for interconnecting a pair of stripline circuit traces.

In accordance with the first embodiment, the interconnect 10 generally includes a substantially cylindrical conductive pin 20 which has first and second ends. The first end of the conductive pin 20 has a female receptacle 21 for receiving an inner conductive wire 17 extending from a coaxial cable 18 to form a straight connection. The inner wire 17 provides an active transmission path in the coaxial cable 18 which continues through the conductive pin 20. The second end of the conductive pin 20 is designed in accordance with the present invention to provide a high performance right-angle electrical coupling to a stripline circuit trace 32 located on a circuit board 30 via a springy compressible conductive button 24. The signal interconnection is substantially surrounded by a reference ground plane and insulated therefrom.

The coaxial connector assembly 50 may generally include a modified conventional SMA connector such as the type manufactured by Omni Spectra Corporation having part number 2052-1201-02 wherein the second end of the conductive pin 20 is modified and designed in accordance with the present invention. The coaxial connector assembly 50 includes a conductive cylindrical housing 14 connected to a metal base plate 12 which is in turn fastened to the housing surrounding the circuit board 30 via machine screws 19. The conductive cylindrical housing 14 has a threaded portion 15 provided on the outer surface thereof for engaging a standard internally threaded male-type SMA connector 16. The standard male-type connector 16 removably fastens the inner conductor 17 of coaxial cable 18 to the first end of the conductive pin 20. Accordingly, the conductive housing 14 provides a reference ground layer that substantially surrounds the active transmission path through the coaxial connector assembly 50.

The interconnect 10 further includes an insulation tube 22 which substantially surrounds the outer sides of the conductive pin 20 so as to provide a coax transmission line of a uniform impedance with respect to the conductive pin 20. The insulation tube 22 and the conductive pin 20 are partially encapsulated by the coaxial connector assembly 50 toward the first end of the conductive pin 20. The remaining portion of the insulation tube 22 and conductive pin 20 extend from the coaxial connector assembly 50 and are adapted to engage a passage 23 in the tipper aluminum housing 42 to achieve electrical contact with the circuit trace 32. The insulation tube 22 has a selected dielectric constant which provides insulation with a controlled impedance between the conductive pin 20 and the aluminum housing 40 and 42. This allows for the achievement of controlled impedance matching with the first and second transmission paths.

The circuit board 30 shown in FIG. 1 has a copper stripline circuit trace 32 etched on top thereof in accordance with standard photolithographic techniques known in the art. The circuit trace 32 and circuit board 30 are in turn located between a lower dielectric layer 38 and an upper dielectric layer 36. Dielectric layers 36 and 38 are generally of a selected dielectric constant. A conductive aluminum housing substantially surrounds the circuit trace 32 and includes a bottom aluminum housing 40 and a top aluminum housing 42. Together the bottom and top aluminum housings 40 and 42 are electrically coupled to the metal base plate 12 of the coaxial connector assembly 50. As a consequence, the aluminum housings 40 and 42, coaxial connector 14, and metal base plate 12 form a continuous ground plane substantially surrounding the signal transmission through the interconnect transition.

In order to access the circuit trace 32, a passage 23 is created which extends through the top aluminum housing 42 and upper dielectric layer 36 of the circuit board 30 so as to expose the top surface of the circuit trace 32. The interconnect 10 is then located so that the conductive pin 20 and insulation tube 22 engage the passage 23 on the circuit board 30. When fully engaged, the conductive pin.20 is electrically coupled to the circuit trace 32 in an optimum manner. For best performance, it is generally required that the passage 23 expose an end portion of the circuit trace 32.

Figure 5:
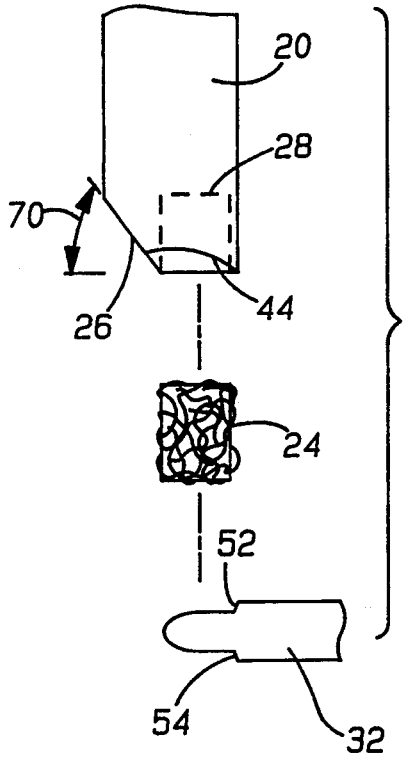
FIG. 5 is an exploded detailed side view of the triple-tapered pin-to-circuit trace connection in accordance with the present invention.

With reference to FIG. 5, the bottom end of the conductive pin 20 has a recessed chamber 28 machined therein which accepts a springy compressible highly conductive button 24. The compressible conductive button 24 is located substantially within the recessed chamber 28 and partially extends therefrom. With the conductive pin 20 of interconnect 10 fully inserted within passage 23 in upper housing 42, the conductive button 24 contacts the stripline circuit trace 32 and is compressed within the recessed chamber 28 in a spring-like manner so as to provide a flexible pressurized electrical contact therewith. In a preferred embodiment, the compressible conductive button 24 is made of one or more strands of beryllium-copper (BeCu) wire plated with gold and woven into a springy compressible fuzz button.

Figure 4:
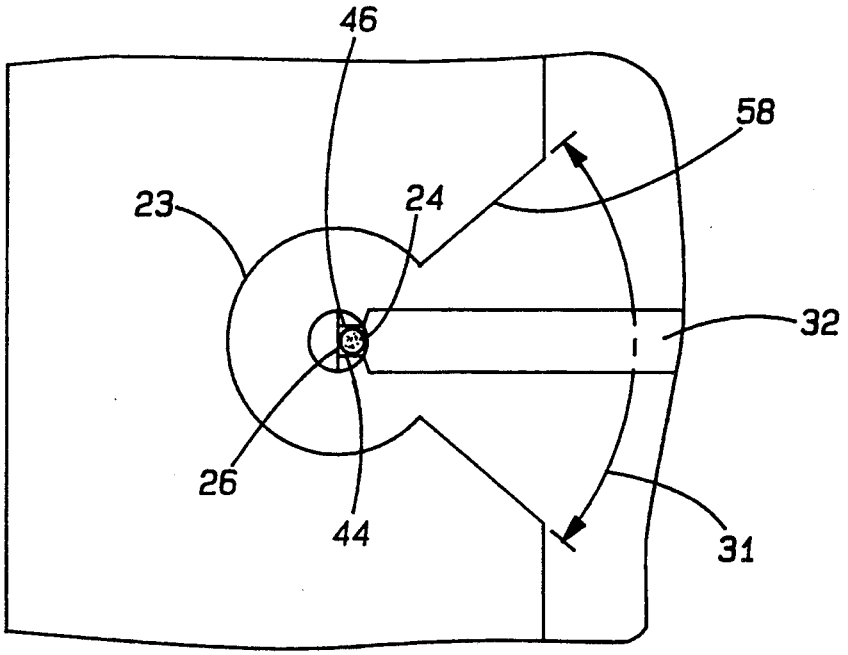
FIG. 4 is a top view taken along line 4—4 in FIG. 2 which illustrates a triple-tapered pin-to-circuit trace connection in accordance with the present invention.
Figure 6:
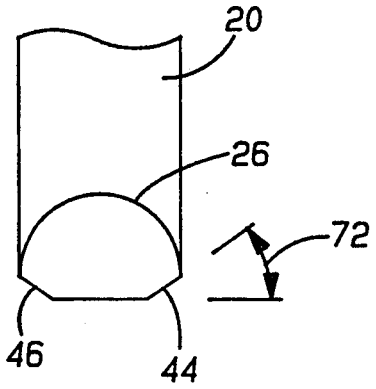
FIG. 6 is a detailed rear view of one end of the conductive pin which further illustrates the tapered edges.

With particular reference to FIGS. 4 through 6, the triple-tapered end of the conductive pin 20 has first, second and third tapered edges 26, 44 and 46. The first tapered edge 26 is formed furthest from the transmission path provided by circuit trace 32, i.e., on the back side. The first tapered edge 26 extends from the inner-most edge of the recessed chamber 28 at the second end of the conductive pin 20 along a plane extending toward the back side of the conductive pin 20 and has a preferred rise in angle 70 of approximately fifty-two degrees (52°) for geometries generally employed herein. However, angle 70 may be with in a range of forty-nine degrees (49°) to fifty-six degrees (56°) depending on specific circuit applications. Accordingly, the first tapered edge 26 improves the high frequency performance of signal transitions between the circuit trace 32 and the conductive pin 20. This is accomplished by reducing transmission line impedance discontinuities and controlling the geometry of the electromagnetic field surrounding the planar stripline trace 32 as it transitions into the cylindrical coaxial transmission line.

The second and third tapered edges 44 and 46 are formed on opposite sides of the compressible conductive button 24 and have bottom cuts formed substantially parallel to the outer edges of the stripline circuit trace 32. Second and third tapered edges 44 and 46 each have a preferred rise in angle 72 of approximately thirty-five degrees (35°). The second and third tapered edges 44 and 46 further increase the high frequency performance of the signal transitions between the stripline circuit trace 32 and the conductive pin 20 as further refinements to achieve the goals achieved by tapered edge 26. That is, by further reducing transmission line impedance discontinuities and further controlling the electromagnetic field surrounding the stripline trace 32.

Figure 7:
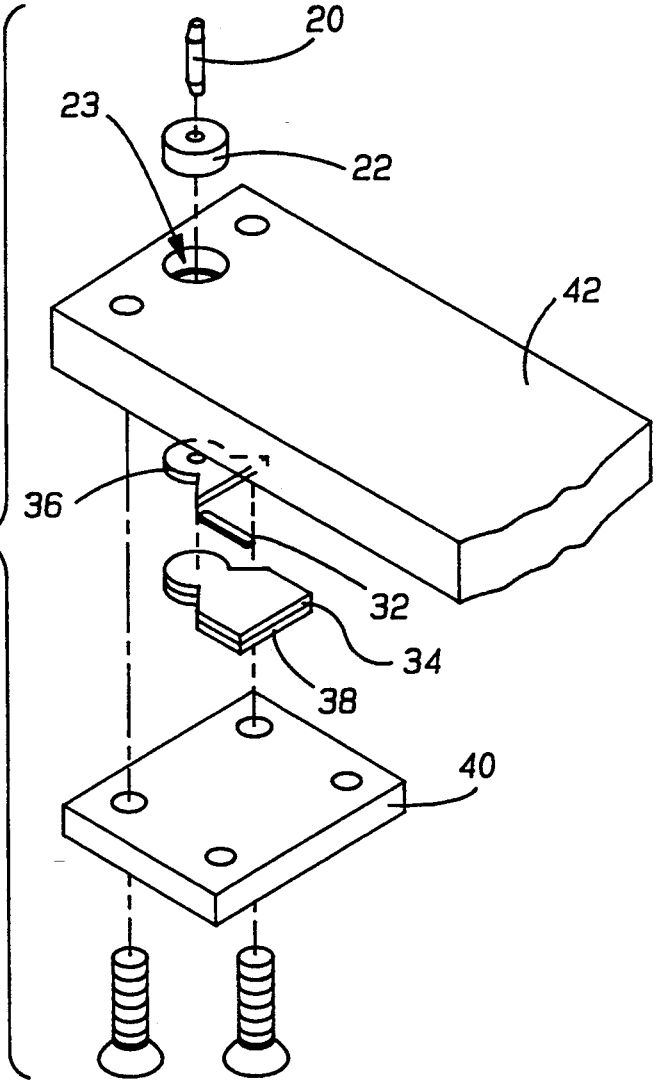
FIG. 7 is an exploded perspective view of the pin to circuit trace interconnect in accordance with the present invention.

In conjunction with the shape of the tapered edges 26, 44 and 46 of the conductive pin 20, the shape outlining the internal portions of the lower aluminum housing 40 as shown is FIGS. 4 and 7 further enhances the performance of the right-angle transition. In particular, a flared opening 58 extends from passage 23 in lower housing 40 in which the opening 58 has a flared angle 31 of approximately eighty-eight degrees (88°). The flared angle 31 further serves to provide enhanced performance.

Figure 3:
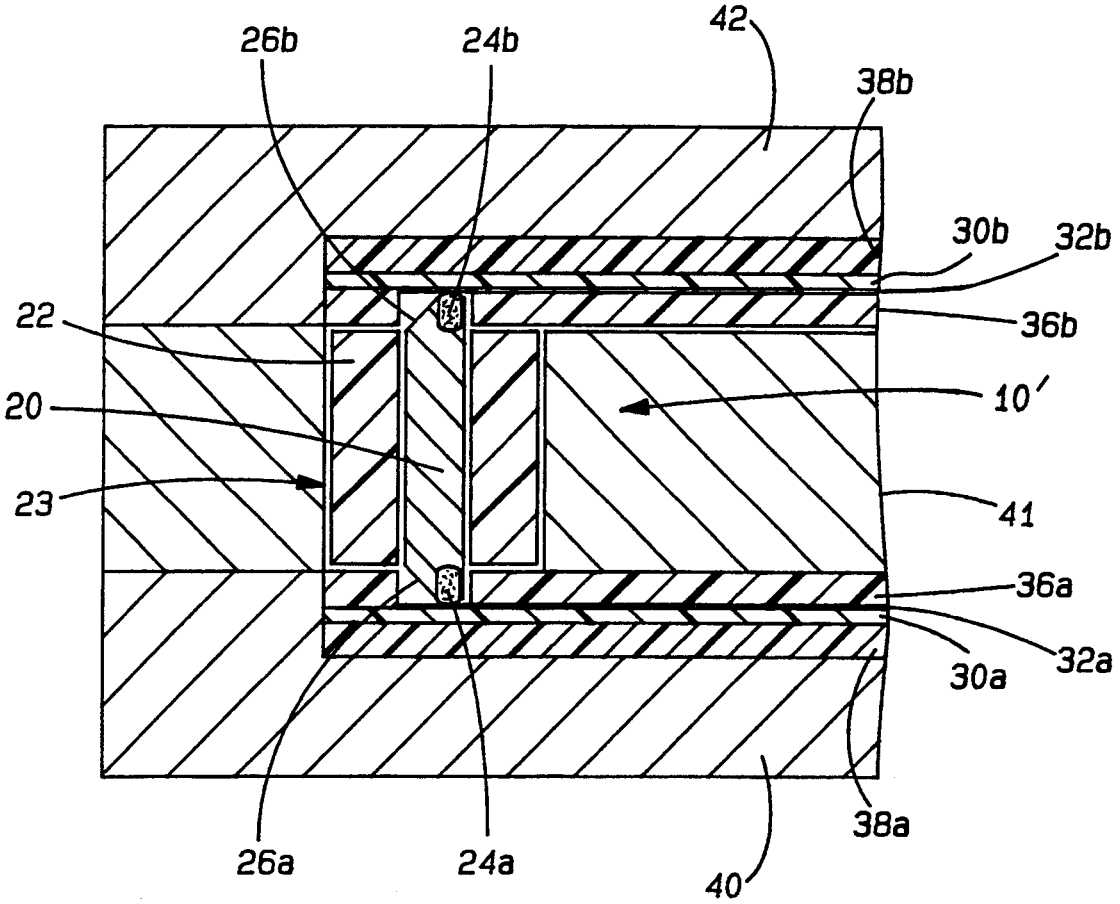
FIG. 3 is a cross-sectional view taken through the center of the pin in an interconnection between two stripline circuit traces within a multi-layer circuit board in accordance with a second embodiment of the present invention.

In accordance with the principles of the present invention, a second embodiment of the interconnect 10' is further provided in FIG. 3 for achieving high frequency signal transitions between a pair of circuit traces 32A and 32B within circuit boards 30A and 30B. The interconnect 10' includes a conductive pin 20' which has a pair of triple-tapered ends electrically coupled between a first circuit trace **32*a* and a second circuit trace 32*b*. The conductive pin 20' is substantially surrounded by a controlled impedance insulation tube 22 and disposed between a first stripline circuit trace 32A and a second stripline circuit trace 32B on respective circuit board 30A and 30B**.

Both triple-tapered ends of the conductive pin 20' have a recessed chamber machined therein as described earlier in accordance with recessed chamber 28 which is adapted to receive a springy compressible conductive button 24A or 24B. That is, the bottom end of the conductive pin 20' contacts a first spring-like compressible conductive button 24A, while the top end of the conductive pin 20' likewise contacts a second spring-like conductive compressible button 24B. The compressible conductive buttons 24A and 24B and associated recessed chambers are located in the same manner as the compressible conductive button 24 as discussed previously in accordance with the first embodiment. The pair of triple-tapered ends of conductive pin 20' each further include a rear tapered edge 26A and 26B, respectively, each being located furthest from the transmission path provided by the associated circuit trace **32*a* or 32*b*. Rear tapered edges 26A and 26B are provided according to first tapered edge 26 as previously discussed. In addition, the second and third tapered edges are likewise formed on both ends of the triple-tapered pin 20' in the same manner as the second and third tapered edges 44 and 46** previously described in the first embodiment.

The assembly of the interconnect 10 and its connection between the conductive pin 20 and the circuit trace 32 are further illustrated in FIGS. 4 through 6. The circuit trace 32 has edges 52 and 54 which narrow the width of circuit trace 32 to a contact area substantially aligned with the compressible conductive button 24. In addition, the upper and lower dielectric layers 36 and 38 likewise have similar edges which conform to the shape of the bottom housing 40. Furthermore, the bottom aluminum housing 40 has opening 58 in the top surface for accepting the first and second dielectric layers 36 and 38 separated by dielectric board 34. This allows the top aluminum housing 42 to lay substantially fiat against the top surface of the bottom aluminum housing 40.

In operation, the first embodiment of the interconnect 10 may be used to form an interconnection between a coaxial connector 50 and a circuit trace 32. Accordingly, a circuit board 30 is provided which is surrounded by controlled impedance dielectric layers 36 and 36 which in turn is surrounded by upper and lower portions of the conductive housing 42 and 40. A passage 23 is formed above a circuit trace 32 on the circuit board 30 through the upper housing 42 and upper dielectric layer 36 so as to expose the circuit trace 32. The interconnect 10 is fastened to the upper housing 42 via screws 19 so that the conductive pin 20 and insulation tube 22 extend into the passage 23 and the springy compressible conductive button 24 contacts the circuit trace 32 under pressure. As a result, the compressible conductive button 24 is compressed within the recessed chamber 28 at the second end of the conductive pin 20. This provides for a continuous pressurized coupling between the conductive pin 20 and the circuit trace 32 despite any adverse operating conditions such as heat changes and flexing of the interconnect 10.

Three tapered edges 26, 44 and 46 are provided at the second end of the conductive pin 20. The conductive pin 20 is then arranged so that the first tapered edge 26 is located furthest from the transmission path on the circuit trace 32. As a result, the first, second and third tapered edge 26, 44 and 46 have the effect of directing high frequency signals through the conductive pin 20 in a manner that efficiently controls the impedance and electromagnetic fields associated herewith.

In accordance with the second embodiment, the interconnect 10' may operate to provide a stripline circuit trace-to-stripline circuit trace interconnection between circuit boards 30A and 30B. In doing so, the interconnect 10′ is fabricated completely within an aluminum conductive housing 40, 41, and 42 which substantially surrounds the circuit traces 32A and 32B. That is, conductive pin 20′ is located between the first circuit trace 32A and the second circuit trace 32B so that compressible conductive buttons 24A and 24B are compressed under pressure between the associated ends of conductive pin 20′ and the respective circuit traces 32A and 32B. In addition, the conductive pin 20′ has a first rear tapered edge 26A formed on one end and a second rear tapered edge 26B formed on the other end. First and second rear tapered edges 26A and 26B are properly arranged so as to provide for increased performance high frequency signal transitions from circuit trace 32A to circuit trace 32B. Furthermore, the controlled impedance insulation tube 22 is likewise disposed between dielectric layer 36A and dielectric layer 36B so as to surround the conductive pin 20′ thereby insulating and providing proper impedance with respect to the conductive aluminum housing 40. Accordingly, high frequency signals are transmitted between circuit traces 32A and 32B via interconnect 10′ and, in so doing, realize relatively low power loss or interference.

Figure 8:
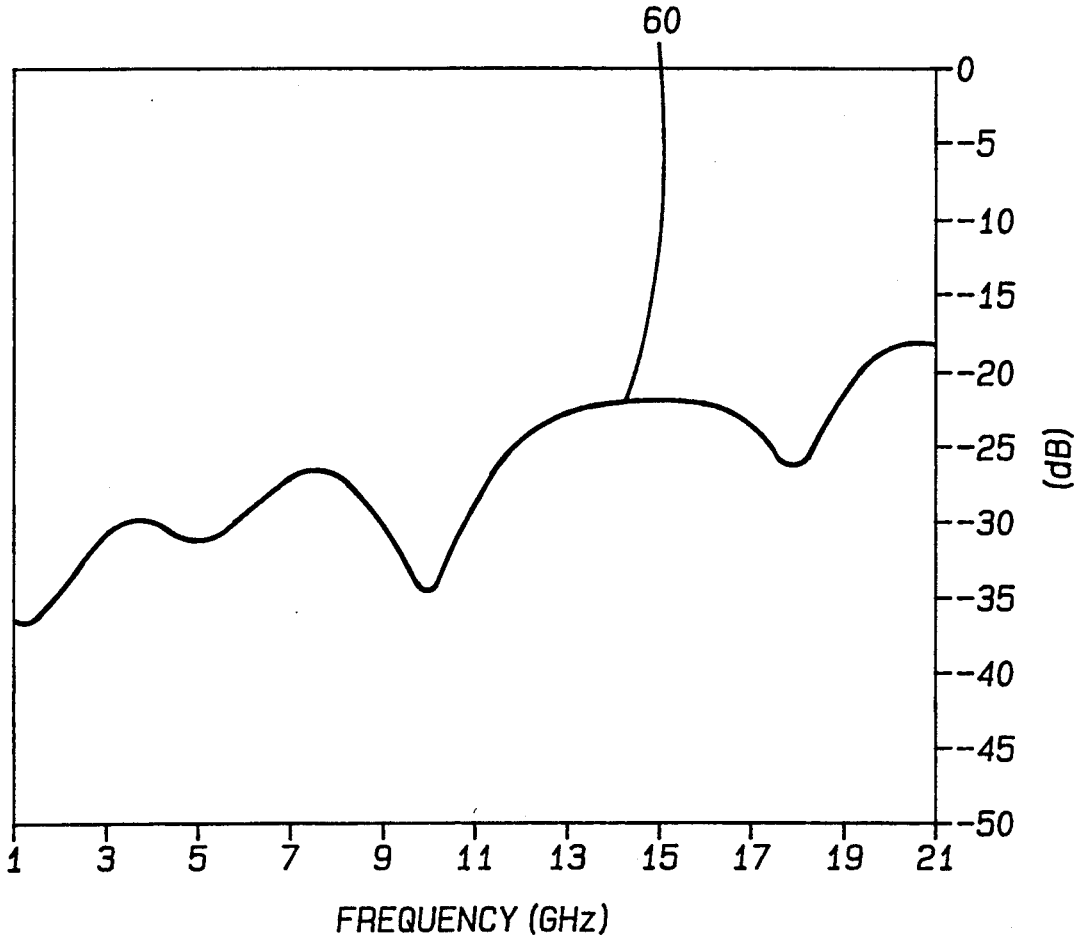
FIG. 8 is a graph which illustrates the performance of return loss versus frequency obtained from one example of a coaxial cable to stripline interconnection in accordance with the first embodiment of the present invention.

FIG. 8 illustrates an example of the return loss response 60 for the interconnect 10 as employed to provide a coaxial connector 50 to stripline circuit trace 32 connection. A perfect interconnect would provide infinite return loss, while the interconnect 10 shown herein provides a worst case response of approximately −22 db over a frequency range of about two to eighteen gigahertz (2–18 GHz).

Accordingly, the features described herein in connection with the present invention prevent propagation and launching of unwanted higher-order transmission line modes into the circuitry within the transmission path. In addition, the features provided herein improve the voltage standing wave ratio (VSWR) match across the interconnection. Improved VSWR match provides for high frequency operation over a wide instantaneous bandwidth such as that ranging from 2–18 GHz. Furthermore, the resulting interconnection allows for a low-profile, lightweight package with enhanced performance and added flexibility in the mechanical packaging of the electronic system.

In view of the foregoing, it can be appreciated that the present invention enables the user to achieve an enhanced performance right-angle interconnect 10 or 10′ for providing right-angle signal transitions at high frequencies. Thus, while this invention has been disclosed herein in combination with a particular example thereof, no limitation is intended thereby except as defined in the following claims. This is because a skilled practitioner recognizes that other modifications can be made without departing from the spirit of this invention after studying the specification and drawings.

What is claimed is:

1. A right-angle electrical interconnect comprising:

a conductive pin having a first end electrically coupled to a first transmission path and a second end for electrically coupling to a circuit trace, said second end having an outermost end shaped with a first flat tapered edge formed on one side of said conductive pin for reducing impedance discontinuities;

a circuit trace having a contact surface located at a right-angle with said first end of said pin for providing a second transmission path; and springy conductive means compressed between said second end of said conductive pin and the contact surface of said circuit trace for providing signal transitions therebetween.

2. The interconnect as defined in claim 1 wherein said first tapered edge is formed toward a side of said pin furthest from said second transmission path.

3. The interconnect as defined in claim 1 wherein said second end said conductive pin further comprises second and third tapered edges formed on opposite sides of said second end.

4. The interconnect as defined in claim 1 wherein said circuit trace is a stripline trace located on a circuit board.

5. The interconnect as defined in claim 1 wherein said springy conductive means comprises wire woven into a compressible mesh.

6. The interconnect as defined in claim 5 wherein said second end of said conductive pin further has a recessed chamber formed therein, said springy conductive means located substantially within said chamber and partially extending therefrom so as to contact said circuit trace under compression.

7. The interconnect as defined in claim 1 wherein said interconnect further comprises:

a conductive medium substantially surrounding said conductive pin for forming a ground reference thereabout; and a controlled impedance insulation layer disposed between said conductive pin and said conductive medium.

8. The interconnect as defined in claim 7 wherein said conductive medium comprises:

a conductive structure substantially surrounding said circuit trace;

an outer conductor surrounding said first transmission path which makes up a coaxial cable; and a coaxial connector having a conductive housing electrically coupling said outer conductor to said conductive structure, and wherein said conductive housing has a flared opening extending above said circuit trace.

9. The interconnect as defined in claim 1 wherein said first end of said conductive pin is coupled to a second circuit trace via a second springy conductive means so as to form a signal transition between two circuit traces.

10. The interconnect as defined in claim 9 wherein said first end of said conductive pin further comprises a tapered edge formed on the side of the pin furthest from said first transmission path.

11. A high frequency right-angle interconnect for providing signal transitions with a circuit trace, said interconnect comprising:

a first transmission path;

a stripline circuit trace having a contact surface and providing a second transmission path;

a conductive pin having a first end electrically coupled to said first transmission path and a second end electrically coupled to said circuit trace, said second end having a plurality of tapered edges including a first flat tapered edge formed on one side at an outermost end of the second end of said conductive pin;

springy conductive means compressed between said second end of said conductive pin and the contact surface of said circuit trace for providing right-angle signal transitions therebetween;

conductive material substantially surrounding said conductive pin for providing a ground reference thereabout; and controlled impedance means separating said conductive pin from said conductive material.

12. The interconnect as defined in claim 11 wherein said second end of said conductive pin further comprises second and third tapered edges located substantially on opposites sides of said second end.

13. The interconnect as defined in claim 11 wherein said first transmission path comprises an inner conductor of a coaxial cable which is connected to said conductive pin via a coaxial connector means.

14. The interconnect as defined in claim 13 wherein said conductive material comprises:

a conductive structure substantially surrounding said circuit trace;

an outer conductor surrounding said first transmission path which makes up a coaxial cable; and a coaxial connector having a conductive housing electrically coupling said outer conductor to said conductive structure.

15. The interconnect as defined in claim 11 wherein said first end of said conductive pin is coupled to a second circuit trace via a second springy conductive means so as to form a signal transition between two circuit traces.

16. The interconnect as defined in claim 15 wherein said first end of said conductive pin further comprises first, second and third tapered edges, said first tapered edge formed on one side of the pin furthest from said first transmission path.

17. A method for forming a solderless right-angle high frequency signal interconnection comprising:

providing a circuit trace for providing a first transmission path;

providing a conductive pin having a first end for electrically coupling to said circuit trace and a second end for electrically coupling to a second transmission path;

forming a flat tapered edge on one side at an outermost end of said first end of said conductive pin which is furthest from said first transmission path; and compressing a springy conductive material between said first end of said conductive pin and said circuit trace.

18. The method as defined in claim 17 further comprising the steps of:

forming a conductive reference ground layer which substantially surrounds said first and second transmission paths.

19. The method as defined in claim 17 further comprising the step of:

forming second and third tapered edges in said second end of said conductive pin.

20. The method as defined in claim 17 further comprising the steps of:

forming a recessed chamber in said first end of said conductive pin; and placing said springy conductive material in said chamber so that said springy conductive material partially extends from said chamber.

21. The method as defined in claim 20 further comprising the steps of:

forming a second chamber in said second end of said conductive pin;

placing a second springy conductive material within said second chamber so that said second springy material partially extends therefrom;

forming a tapered edge on said second end of said conductive pin; and electrically coupling said second end of said conductive pin to a second circuit trace so that said second springy conductive material is compressed between said second end of said conductive pin and said second circuit trace.

22. A high frequency electrical interconnect apparatus for providing right-angle signal transitions between first and second transmission paths, said apparatus comprising:

a conductive pin having a first end electrically coupled to the first transmission path and a second end electrically coupled to the second transmission path;

a first flat tapered edge formed on an outermost end of the second end of the conductive pin;

second and third tapered edges formed on the second end of the conductive pin on substantially opposite sides of one another; and a springy conductive means compressed between the second end of the conductive pin and a conductor forming the second transmission path for providing signal transitions therebetween.

* * * * *